United States Patent [19]

Woodward

[11] 3,943,855

[45] Mar. 16, 1976

[54] COMPUTER FOR MISSILE

[75] Inventor: Kenneth E. Woodward, McLean, Va.

[73] Assignee: The United States of America as represented by the Secretary of the Army, Washington, D.C.

[22] Filed: May 25, 1964

[21] Appl. No.: 370,403

[52] U.S. Cl. ..... 102/70 R; 102/81; 102/82; 235/201 PF

[51] Int. Cl.[2] ..... F42C 5/00

[58] Field of Search ..... 102/70, 81, 82; 235/201; 137/81.5; 73/515, 521

[56] References Cited

UNITED STATES PATENTS

| | | | |
|---|---|---|---|
| 2,953,094 | 9/1960 | Cohan | 102/82 |
| 2,994,271 | 8/1961 | Silver et al. | 102/82 X |
| 3,066,605 | 12/1962 | Jones | 102/81 X |
| 3,111,291 | 11/1963 | Horton | 60/35.55 |
| 3,122,039 | 2/1964 | Sowers | 137/81.5 X |
| 3,135,291 | 6/1964 | Kepler et al. | 60/35.54 |

*Primary Examiner*—David H. Brown

*Attorney, Agent, or Firm*—Nathan Edelberg; Robert P. Gibson; Saul Elbaum

EXEMPLARY CLAIM

1. A fluid fuze comprising:
   a. a fluid detector,
   b. a pure fluid computer, said computer having an input connected to said fluid detector and an output,
   c. said pure fluid computer including a bi-stable fluid amplifier and at least one pulse converter, and
   d. a fluid utilization device connected to an output of said pure fluid computer.

5 Claims, 7 Drawing Figures

Figure 1:
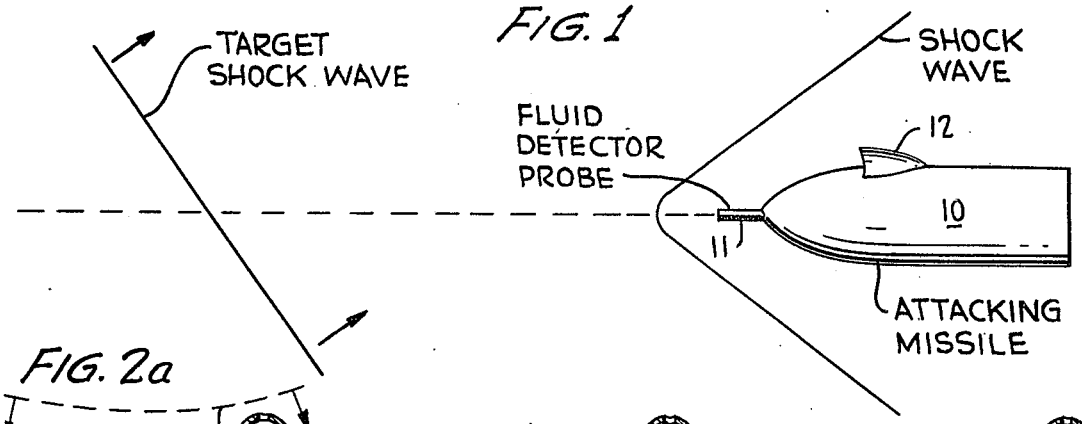

INVENTOR,
KENNETH E. WOODWARD

BY: Harry M. Saragovitz,
Edward J. Kelly,
Herbert Berl &
J. P. Edgerton

INVENTOR,
KENNETH E. WOODWARD

BY: Harry M. Saragovitz, Edward J. Kelly, Herbert Berl, and J. P. Edgerton

COMPUTER FOR MISSILE

The invention described herein may be manufactured and used by or for the Government of the United States of America for governmental purposes without the payment to me of any royalty thereon.

This invention relates to pure fluid systems and more particularly to pure fluid fuzes.

The advent of pure fluid amplification techniques (pure fluid systems) has given the military the possibility of substituting pure fluid components for many of the complex electronic and electromechanical devices now performing such tasks as warhead safing, arming, and fuzing. The potential reliability, reproducibility, environmental ruggedness, immunity to countermeasures and jamming, safety, reduction in weight and size, and low production cost represent significant military advantages. Pure fluid devices have no moving parts, and in many applications can perform in place of an electronic or mechanical device.

One area proposed for the use of pure fluid systems is projectile and/or missile control. The ruggedness, reliability, immunity from jamming, and cheapness are all advantages of such a system. Several such systems have been proposed, and missile control or fuzing systems employing pure fluid components have commonly employed either self-contained, inertial type systems, or if they are designed for object detection and/or environmental sensing, they have employed conventional electronic detection techniques. Such systems using conventional inputs are adequate and necessary, for some applications. However, this type of system does interject one potentially weak link in the system — expensive, temperamental and jammable — the sensor.

One object of this invention is to provide a missile control and/or fuze which is pure fluid. That is, the system employs a fluid detector and an integrated fluid computer eliminating the need for electro-pneumatic or mechanical-pneumatic transducers.

Another object of this invention is to provide a pure fluid, shock wave detection, fuzing system.

An additional object of this invention is to provide a pure fluid distance computer.

Still another object of this invention is to provide a pure fluid fuzing system which does not need to carry a fluid supply and which is safe to handle and store before firing.

A further object of this invention is to provide a differentiator sensitive to a fluid shock wave which can actuate a bi-stable fluid amplifier.

One more object of this invention is to provide a fluid integrator.

An additional object of this invention is to provide a fluid operated distance computer.

One further object of this invention is to provide a pure fluid detector with a single fluid signal input detector.

These and other objects of the present invention are accomplished through the use of a fluid detector probe in combination with a pure fluid computer.

The specific nature of the invention, as well as other objects, aspects, uses and advantages thereof, will clearly appear from the following description and from the accompanying drawing, in which:

FIG. 1 represents a missile employing the teachings of this invention approaching a target.

Figure 2A:
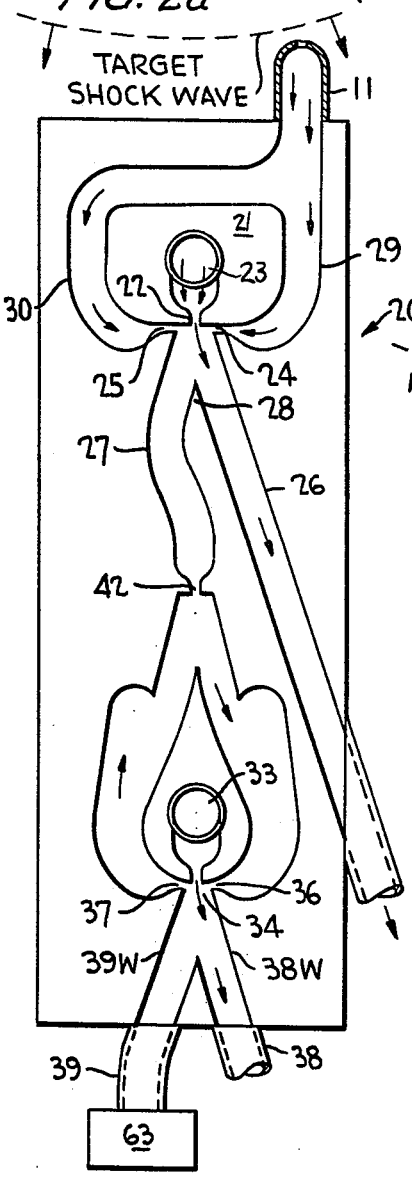
Figure 2B:
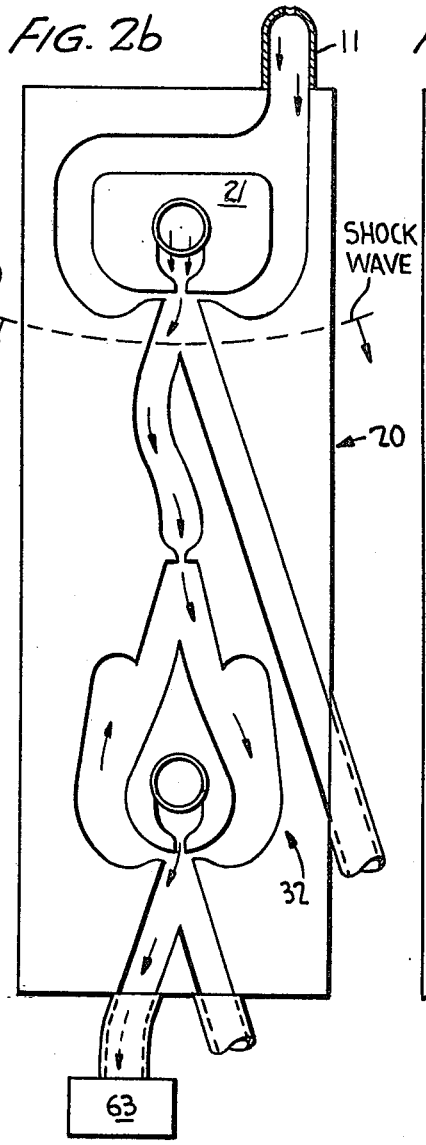
Figure 2C:
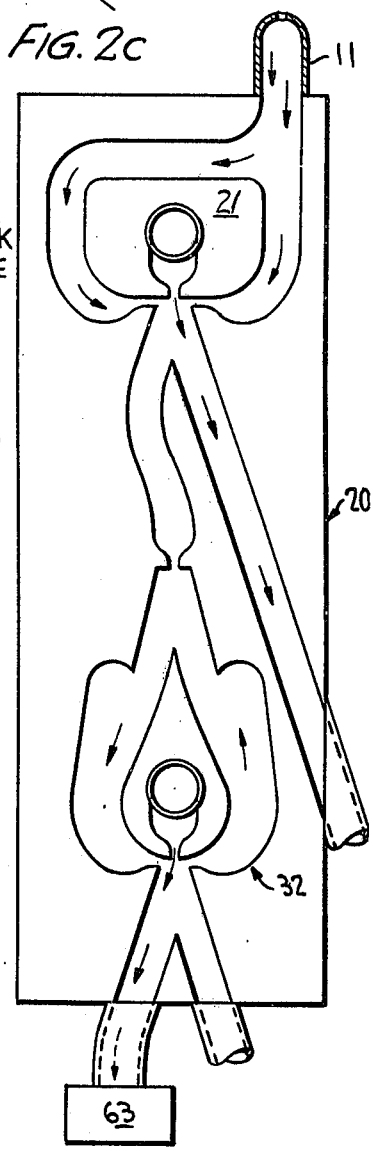

FIGS. 2(*a*), 2(*b*) and 2(*c*) are plan views of one embodiment of this invention which is shock wave operated.

Figure 3A:
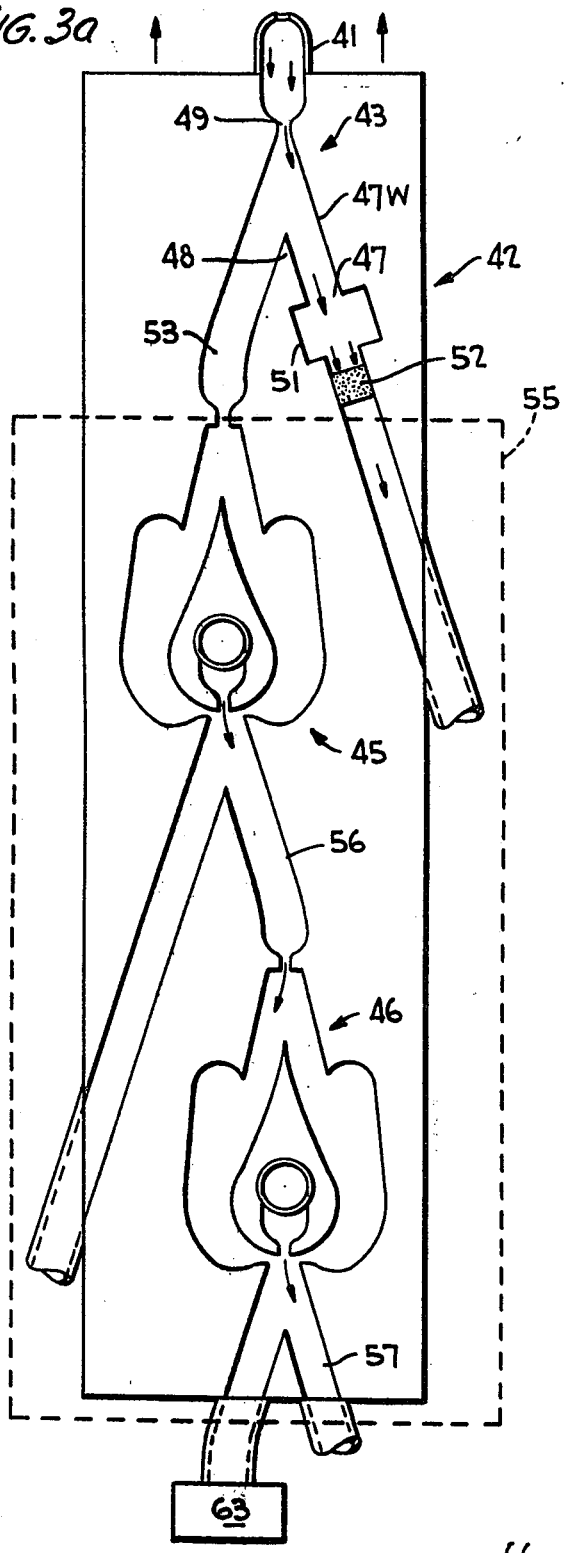
Figure 3B:
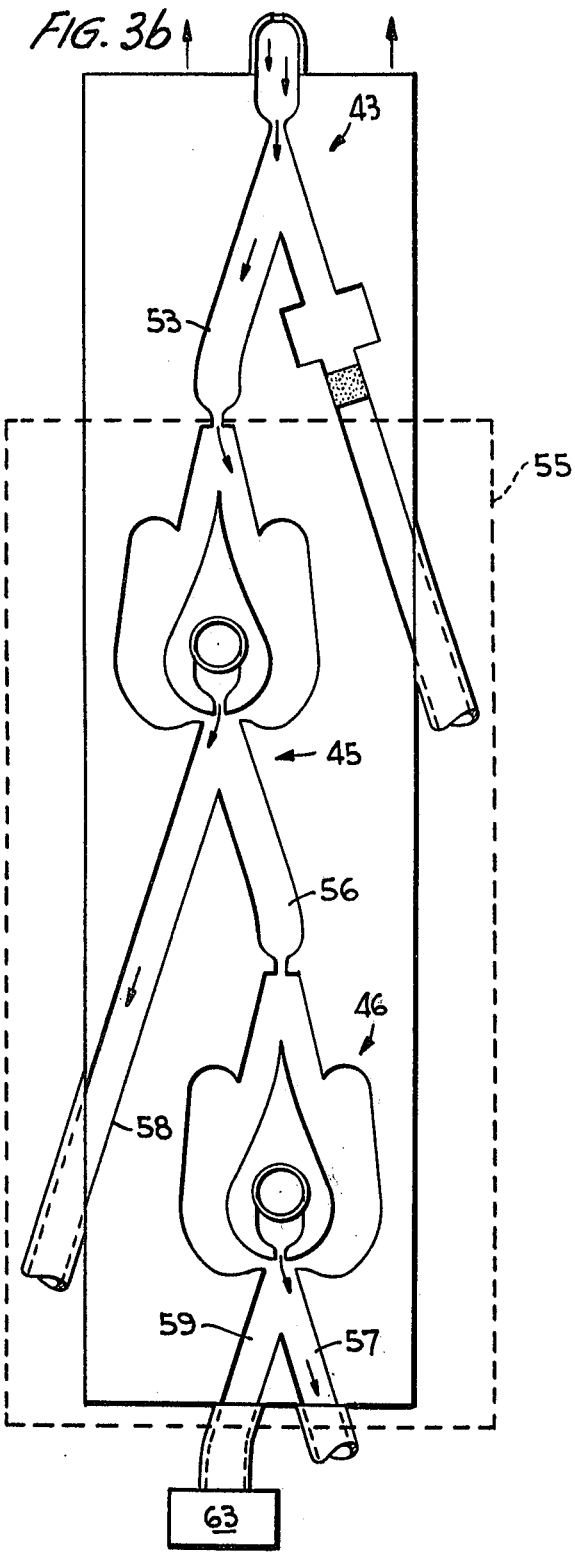

FIGS. 3(*a*) and 3(*b*) are plan views of a distance computing embodiment of this invention.

Figure 4:
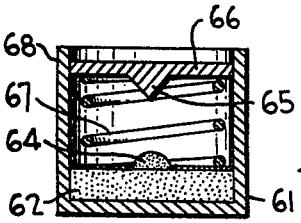

FIG. 4 shows one embodiment of a fluid operated detonator.

FIG. 1 shows an attacking missile 10 with a fluid detector probe 11 mounted thereon. The probe 11 is essentially a piece of tube in the embodiment shown, and this is satisfactory for most purposes. The fluid (air or water in most applications) surrounding the missile 10 enters the probe 11 and is the input signal to a fluid computer inside the missile, as will be explained subsequently. The pure fluid computer aboard the missile operates upon the received signal from probe 11 to cause a desired operation.

Mounted on the missile 10 is a small air scoop 12. This scoop 12 can supply the fluid to operate the fluid computer. Where this type of fluid computer supply is employed, two beneficial results are achieved. No auxiliary fluid supply is required — a weight and space saving — and some safing and arming is achieved since there can be no power to the fluid computer until the missile is launched.

FIG. 2 shows the single probe 11 in combination with a shock wave detector and distance computer indicated generally at 20. Fluid flow in the computer is indicated by the arrows.

FIG. 2(*a*) represents the state of the computer before the arrival of the shock wave.

FIG. 2(*b*) represents the state of flow in the computer immediately after the shock wave has arrived and at detonation.

FIG. 2(*c*) shows the fluid flow conditions at a time after that shown in FIG. 2(*b*).

The fluid computer 20, shown in FIG. 2 has two stages, although skilled persons will realize that the stages shown are only representative of the type and number of stages which may be employed. In order to provide a more sophisticated operation, several additional elements could be employed.

The first stage of the fluid computer 20 is a shock actuated fluid amplifier 21. The fluid amplifier 21 consists of a power jet nozzle 22 connected to a power supply 23 which, in a preferred embodiment, is connected to a fluid scoop 12. On the side of the power jet nozzle 22 are right and left control jets 24 and 25. Down stream from the power nozzle 22 are two output receiver channels 26 and 27. The right channel 26 exhausts outside the missile and the left channel 27 is connected to the next stage of the computer. The fluid power jet issuing from nozzle 22 is baised to normally flow out of exhaust channel 26, as indicated by the arrows in FIG. 2(*a*). This may be accomplished by any of a number of schemes known in the art. Amplifier 21 may be biased by placing the splitter 28 slightly to the left of the centerline of the power nozzle 22. However, normally a symmetrical amplifier may be used, sufficient bias being provided by nozzle 25, as will appear below.

The right control nozzle 24 is connected to the single probe 11 by channel 29 and the left control nozzle 25 is connected to the single probe 11 by channel 30. The channel 29 is of low inertness and high resistance, while channel 30 is of relatively high inertness and low resistance. This relation between lines 29 and 30 may be achieved by making channel 30 longer than channel 29 and placing a porous plug resistor in the line 29 (not shown). The low resistance in channel 30 allows more flow to nozzle 25, biasing the stream into channel 26. The low inertness of channel 29 means that changes in input pressure will be transmitted to nozzle 24 ahead of nozzle 25.

The next stage of the computer 20 is a fluid pulse converter 32 which is connected to output channel 27 of amplifier 21. This pulse converter 32 has a fluid power supply 33, (preferably fed from fluid scoop 12) a power jet nozzle 34, right and left control nozzles 36 and 37 and right and left output channels 38 and 39.

This bi-stable fluid element is fully disclosed in U.S. Pat. No. 3,001,698 issued to R. W. Warren, to which reference is made for details of construction and operation.

The operation of the pulse convertor is: fluid flow from power supply 33 is initially directed out of exhaust channel 38. This can be accomplished, as pointed out in the aforementioned Warren patent, by making the system slightly asymmetrical. One way to do this is to locate the nozzle 34 closer to the right wall 38w which forms one side of channel 38. Flow in channel 38 is one stable state of the pulse converter 32, and flow from power supply 33 continues out of channel 38 until a fluid pulse is received from amplifier 21 via channel 27 and a nozzle 42. A fluid pulse applied to the convertor 32 via nozzle 42 causes the fluid stream to switch out of channel 38, become attached to the left hand wall 39w and issue from channel 39 into a fluid operated detonator 63. One suitable fluid operated detonator is shown in FIG. 4 and will be described subsequently.

The overall operation of the fuze 20 may now be explained in connection with FIGS. 2(*b*) and 2(*c*) in conjunction with FIG. 2(*a*). FIG. 2(*a*) shows the initial flow state with fluid flow from power supply 23 issuing exhaust channel 26 and fluid flow from pulse convertor 32 exhausting from channel 38.

Before the arrival of a shock wave, fluid enters the probe 11 and passes through channel 29 and 30 to nozzles 24 and 25. Since line 30 is of lower resistance than line 29, this fluid does not tend to switch power jet issuing from nozzle 22.

A shock wave detected by the probe 11 causes the amplifier 21 to switch. The mechanism can be seen in FIG. 2(*b*). The shock wave detected by the probe 11 is transmitted through the low inertance, high resistance line 29 and reaches the right hand nozzle 24 before the shock wave transmitted through high inertance channel 30 reaches nozzle 25. The high pressure associated with the shock wave causes the power jet from nozzle 22 to momentarily switch and issue from the left hand channel 27. This flow in channel 27 is applied through nozzle 42 to pulse convertor 32, causing it to switch into the left hand output 39, and this output is applied to fluid utilization device 63.

FIG. 2(*c*) shows the final state. After the shock wave has passed, the amplifier 21 returns to its initial state with fluid issuing from exhaust channel 26. However, pulse convertor 32 is bi-stable and fluid from the power supply 33 continues to be applied to detonator 63 via channel 39. When sufficient fluid has been applied to detonator 63, it functions.

FIG. 3 illustrates another embodiment of this invention which can measure the distance traveled by a vehicle or warhead to which it is attached. One fuzing application of this pure fluid distance measuring scheme is for the fuzing bomblets of a cluster warhead. In a cluster warhead the principle missile or bomb explodes, releasing a large number of secondary explosives or bomblets. The desired operation is to have these secondary bomblets detonate at a predetermined distance away from the principal bomb. As will appear, the embodiment of FIG. 3 is admirably suited for this application.

The embodiment of FIG. 3 is comprised of pure fluid detector probe 41, the same as that used in the embodiment of FIG. 2, connected to a two stage computer 42. The first stage of computer 42 is a time-velocity integrator 43. The second stage of the computer 42, in the particular embodiment shown, consists of two fluid pulse convertors 45 and 46, identical to those described in the aforementioned Warren patent.

With the computer 42 carried by a missile traveling in the direction of the arrows, fluid enters the probe 41 and is applied to the integrator 43. The integrator 43 is essentially a bi-stable fluid amplifier biased so that flow is initially from the exhaust channel 47. One way this can be accomplished, as previously mentioned, is by placing the splitter 48 to the left of the centerline of nozzle 49. Control nozzles may also be provided in the conventional manner in integrator 43 in order to provide bias and help insure stable operation. In the exhaust channel 47 there is a fluid capacitor 51 and a fluid resistor 52. Where the fluid is compressible, such as air, the fluid capacitor 51 can be merely an expanded chamber with a non-aligned inlet and outlet. If it is incompressible fluid, such as water, a flexible diaphragm chamber must be used. The resistor 52 can be a porous plug.

The integrator 42 operates as follows: fluid entering probe 41 initially is directed into the exhaust channel 47. This fluid "charges" the RC combination of capacitor 51 and resistor 52 until the pressure in this channel has reached a predetermined amount. When this predetermined back pressure has been reached, it causes the fluid flow to become detached from the right hand wall 47w of channel 47, switch, and flow from an output channel 53. Flow continues in channel 53 until the pressure builds up in that channel and decreases in channel 47, then the flow switches back to channel 47. This produces an output pulse to the counting stage 55 (enclosed in the dotted lines) of the computer 42. The output pulse rate will be dependent upon the rate of fluid build up in the fluid resistor-capacitor network in exhaust channel 47. The build up rate depends upon the velocity-time product of the vehicle as it moves through the fluid medium. The output of the first stage represents the product of the velocity and time in a digitalized form, and this represents the distance the vehicle has traveled.

In order to provide for a certain fixed distance before detonation a two stage counter 45 is provided. Obviously, the number of stages will be dependent upon the distance (delay) desired, and for some applications none will be required. The two stage counter 55 is identical in operation to the counter shown in FIGS. 4 through 9 of the aforementioned Warren U.S. Pat. No. 3,001,698, and a detailed explanation would merely be repetitious and unnecessary.

The overall operation of the fuze may be seen from the flow patterns in FIGS. 3(*a*) and 3(*b*). Initially the flow pattern is that shown in FIG. 3(*a*). Fluid entering probe 41 charges capacitor 51. Fluid power feeding pulse convertor 45 (preferably from scoop 12) is caused initially to flow into the right hand channel 56 due to a geometric bias. Fluid flow in pulse convertor 46 is also initially directed into the right hand channel 57 by a bias.

After the capacitor 51 has charged, and the power stream switches, the flow configuration is that shown in FIG. 3(*b*). Fluid power in output channel 53 causes flow in pulse convertor 45 to switch and be issued from channel 58. This switching of convertor 45 does not affect the flow in convertor 46 and its flow continues in channel 57.

The flow in integrator 43 switches back to channel 46 after the pressure in that channel has decreased and capacitor 51 is again charged. Flow in pulse convertors 45 and 46 are unaffected by this switching of the integrator 43 into channel 47, and the flow in 45 and 46 remains as shown in FIG. 3(*b*).

The next output pulse from integrator 43 in channel 53 causes convertor 45 to switch producing flow in channel 56. This flow in channel 56 causes convertor 46 to switch, producing flow in channel 59 which is connected to detonator 63 causing the fuze to function.

FIG. 4 shows one embodiment of a fluid activated detonator 63 which may be used in the practice of this invention. The fluid operated detonator consists of casing 61 with explosive powder 62 at one end. A percussion cap 64 is located beneath a striker 65 mounted on a plunger 66. The cap 64 and the striker 65 are held apart by a spring 67.

In operation, the output of the fluid computer is connected to the end 68 and an output from the computer applies pressure to the plunger 66. This fluid pressure forces the plunger down, with the striker 65 hitting cap 64 detonating explosive 62. This explosion can initiate an explosive train to a main explosive carried by the missile.

It will be apparent that the embodiments shown are only exemplary and that various modifications can be made in construction and arrangement within the scope of the invention as defined in the appended claims.

I claim as my invention:

1. A fluid fuze comprising:

a. a fluid detector, b. a pure fluid computer, said computer having an input connected to said fluid detector and an output, c. said pure fluid computer including a bi-stable fluid amplifier and at least one pulse converter, and d. a fluid utilization device connected to an output of said pure fluid computer.

2. A fluid fuze comprising:

a. a fluid shock wave detector probe, b. a fluid computer, said computer having a fluid input signal means and a fluid output signal means, said input signal means connected to said shock wave detector, c. said fluid computer including a bi-stable fluid amplifier, and d. a fluid operated detonator connected to an output of said fluid amplifier.

3. A fluid shock wave detector comprising:

a. a bi-stable, pure fluid amplifier having a power jet nozzle, a plurality of fluid receiving channels with means to bias jet flow from said nozzle into a first one of said channels, and fluid signal control means adapted to direct said jet flow into a second one of said channels upon receipt of a shock wave, and b. a detector probe, an input to said probe in an ambient fluid, and an output of said probe connected to said signal control means.

4. A fluid shock wave detector comprising:

a. a bi-stable fluid amplifier having a power jet nozzle, a first and a second fluid receiving channel, and a first control nozzle adapted to direct a flow from said jet nozzle into said first channel and a second control nozzle adapted to direct a flow from said jet nozzle into said second channel, and b. a detector probe, an input to said probe in an ambient fluid and an output of said probe connected to said first and second control nozzles by separate channels, one of said channels having a low resistance and a high inertance, and the other of said channels having a high resistance and low inertance.

5. A fluid fuze comprising:

a. a fluid probe, said probe oriented with respect to a missile carrying said probe that the amount of fluid entering said probe is proportional to the velocity of said probe through a fluid, b. a pure fluid integrator, said integrator producing a fluid pulse output, c. means to count said output pulses, said counting means producing an output after a predetermined number of counts, and d. said counter output connected to a fluid operated detonator.

* * * * *